US007546052B2

(12) United States Patent
Kitamura

(10) Patent No.: US 7,546,052 B2
(45) Date of Patent: Jun. 9, 2009

(54) IMAGE FORMING APPARATUS AND METHOD OF CONTROLLING CHARGING THE APPARATUS TO REDUCE WARM UP TIME

(75) Inventor: Tetsuo Kitamura, Mishima (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 142 days.

(21) Appl. No.: 11/688,521

(22) Filed: Mar. 20, 2007

(65) Prior Publication Data

US 2008/0232839 A1 Sep. 25, 2008

(51) Int. Cl.
*G03G 15/20* (2006.01)
*G03G 15/00* (2006.01)

(52) U.S. Cl. ..... 399/70; 219/216; 399/88

(58) Field of Classification Search ..... 399/70, 399/69, 88, 320, 328; 219/216
See application file for complete search history.

(56) References Cited

U.S. PATENT DOCUMENTS 6,629,182 B1 9/2003 Mizoguchi et al.
7,212,759 B2 * 5/2007 Kishi et al. ..... 399/69
2004/0086293 A1 * 5/2004 Atsushi et al. ..... 399/69
2004/0141767 A1 * 7/2004 Hiroto ..... 399/88
2004/0245235 A1 * 12/2004 Kishi et al. ..... 219/216
2005/0123314 A1 * 6/2005 Satoh ..... 399/69
2005/0191078 A1 * 9/2005 Kishi et al. ..... 399/88
2006/0039713 A1 * 2/2006 Kishi et al. ..... 399/69
2006/0051120 A1 * 3/2006 Kishi et al. ..... 399/69
2006/0127118 A1 * 6/2006 Kishi et al. ..... 399/69
2006/0222395 A1 * 10/2006 Yoda ..... 399/69

FOREIGN PATENT DOCUMENTS

JP 2002-357966 A * 12/2002
JP 2003-140484 A * 5/2003
JP 2005-174589 6/2005

* cited by examiner

*Primary Examiner*—Sophia S Chen
(74) *Attorney, Agent, or Firm*—Turocy & Watson, LLP

(57) ABSTRACT

When a main switch 11 is off, an electricity storage device 93 is charged with electric power of a commercial AC power supply 80 . When the main switch 11 is on and warming-up of a fixing unit 35 is necessary, a halogen heater 51 in a heating roller 41 is actuated by the electric power of the commercial AC power supply 80 and a halogen heater 52 in the heating roller 41 is actuated by discharge electric power of the electricity storage device 93.

15 Claims, 5 Drawing Sheets

IMAGE FORMING APPARATUS AND METHOD OF CONTROLLING CHARGING THE APPARATUS TO REDUCE WARM UP TIME

BACKGROUND OF THE INVENTION

1. Field of the Invention

The present invention relates to image forming apparatuses such as a copying machine and a printer.

2. Description of the Related Art

In image forming apparatuses such as a copying machine and a printer, an original stand on which an original is placed is exposed to light and reflected light from the original stand is guided to a photoelectric conversion element, for example, a CCD (charge coupled device). The CCD outputs an image signal corresponding to an image of the original. A laser beam corresponding to this image signal is irradiated on a photoconductive drum and an electrostatic latent image is formed on a peripheral surface of the photoconductive drum.

The electrostatic latent image formed on the peripheral surface of the photoconductive drum is visualized by a developing agent (a toner). A sheet is sent to the photoconductive drum to be timed to coincide with rotation of the photoconductive drum and a visible image (a developing agent image) on the photoconductive drum is transferred onto the sheet. The sheet having the developing agent image transferred thereon is sent to a fixing unit. The fixing unit includes a heating roller and a pressure roller that rotates together with the heating roller while being in contact with this heating roller in a pressing state. The fixing unit fixes the developing agent image on the sheet with heat of the heating roller while conveying the sheet with the sheet nipped between both the rollers. The heating roller incorporates an electric heater as a heat source.

On the other hand, to reduce waiting time of a user and for energy saving measures, it is desired to reduce time required for warming-up of the fixing unit.

BRIEF SUMMARY OF THE INVENTION

It is an object of an image forming apparatus of an aspect of the invention to make it possible to reduce time required for warming-up of a fixing unit.

An image forming apparatus according to an aspect of the invention includes: a main switch that permits an operation of the image forming apparatus by electric power of a main power supply according to turn-on of the main switch and prohibits the operation according to turn-off of the main switch; a fixing unit having a heating roller; a first electric heater and a second electric heater provided in the heating roller; an electricity storage device that can be charged and discharged; and a controller that charges the electricity storage device with the electric power of the main power supply when the main switch is off and, when the main switch is on and warming-up of the fixing unit is necessary, actuates the first electric heater with the electric power of the main power supply and actuates the second electric heater with discharge electric power of the electricity storage device.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate presently preferred embodiments of the invention, and together with the general description given above and the detailed description of the preferred embodiments given below, serve to explain the principles of the invention.

DETAILED DESCRIPTION OF THE INVENTION

[1] A first embodiment of the invention will be hereinafter explained with reference to the drawings.

Figure 1:
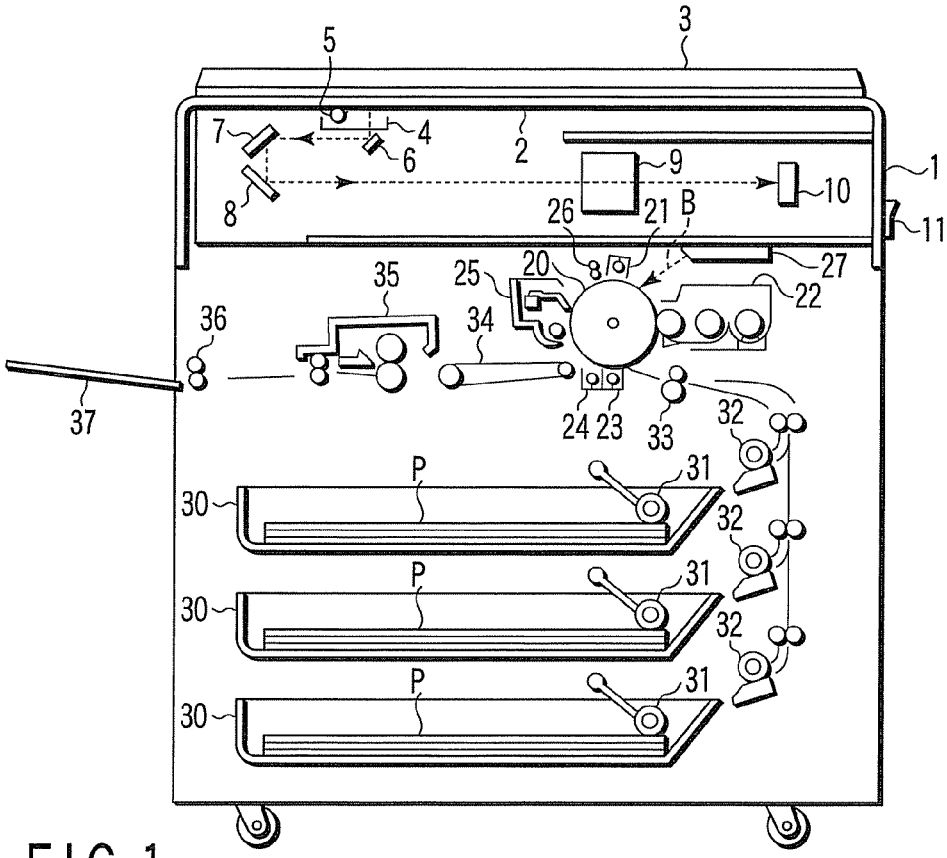
FIG. 1 is a diagram showing a structure of each embodiment.

As shown in FIG. 1, a transparent original stand (glass plate) 2 for setting an original is provided in an upper part of a main body 1. A platen cover 3 is provided on the original stand 2 to be opened and closed freely. A carriage 4 is provided on a lower surface side of the original stand 2. An exposure lamp 5 is provided in the carriage 4. The carriage 4 can reciprocatingly move along the lower surface of the original stand 2. The exposure lamp 5 is lit while the carriage 4 is reciprocatingly moving, whereby an original set on the original stand 2 is exposed to light.

According to this exposure, a reflected light image of the original placed on the original stand 2 is obtained. The reflected light image is projected on a CCD (Charge Coupled Device) 10 by reflecting mirrors 6, 7, and 8 and a lens block for magnification 9. The CCD 10 outputs a signal of a voltage level corresponding to a light reception amount.

A scanner that optically scans the original placed on the original stand 2 is constituted by the carriage 4, the exposure lamp 5, the reflecting mirrors 6, 7, and 8, the lens block for magnification 9, and the CCD 10. After an image signal outputted from the CCD 10 is amplified and converted into a digital signal and the digital signal is subjected to image processing, the digital signal is supplied to a laser unit 27. The laser unit 27 emits a laser beam B corresponding to the input signal.

A photoconductive drum 20 is provided to rotate freely in substantially the center in the main body 1. A charging unit 21, a developing unit 22, a transferring unit 23, a peeling unit 24, a cleaner 25, and a charge removing unit 26 are disposed in order around this photoconductive drum 20. The laser beam B emitted from the laser unit 27 is irradiated on the surface of the photoconductive drum 20 through a space between the charging unit 21 and the developing unit 22.

Plural cassettes 30 are provided at the bottom in the main body 1. A large number of paper sheets P of sizes different from one another are stored in these cassettes 30. When a print key is turned on, the paper sheets P are taken out one by one from any one of the cassettes 30. As a roller for taking out the paper sheets P, a pickup roller 31 is provided in each of the cassettes 30. The paper sheets P taken out are separated from the cassette 30 by a separating unit 32 and sent to registration rollers 33. The registration rollers 33 deliver the paper sheet P to a space between the photoconductive drum 20 and the transferring unit 23 at timing set taking into account rotation of the photoconductive drum 20.

The charging unit 21 applies a high voltage to the photoconductive drum 20 to charge the surface of the photoconductive drum 20 with electrostatic charges. The laser beam B emitted from the laser unit 27 is irradiated on the surface of the photoconductive drum 20 subjected to this charging. The laser unit 27 subjects the surface of the photoconductive drum 20 to main scanning in one direction and forms, with sub-scanning for repeating the main scanning according to the rotation of the photoconductive drum 20, an electrostatic latent image corresponding to the image scanned by the scanner on the surface of the photoconductive drum 20.

The electrostatic latent image formed on the photoconductive drum 20 is visualized by receiving a developing agent (a toner) from the developing unit 22. This visible image is transferred onto the paper sheet P by the transferring unit 23. The paper sheet P subjected to the transfer is peeled from the photoconductive drum 20 by the peeling unit 24. The developing agent and the charges remain on the surface of the photoconductive drum 20 from which the paper sheet P is peeled. The remaining developing agent is removed by the cleaner 25. The remaining charges are removed by the chare removing unit 26.

The paper sheet P peeled from the photoconductive drum 20 is sent to a fixing unit 35 by a conveyor belt 34. The fixing unit 35 fixes the image transferred on the paper sheet P with heat. The paper sheet P subjected to the fixing is discharged to a tray 37 by a paper discharge roller 36. A printer that prints the image read by the scanner on the paper sheet P is constituted by the constitution from the photoconductive drum 20 to the tray 37.

A main switch 11 is provided on a side of the main body 1. This main switch 11 permits operations of the image forming apparatus by electric power of a commercial AC power supply 80 described later according to turn-on of the main switch 11 and prohibits the operations according to turn-off of the main switch 11.

Figure 2:
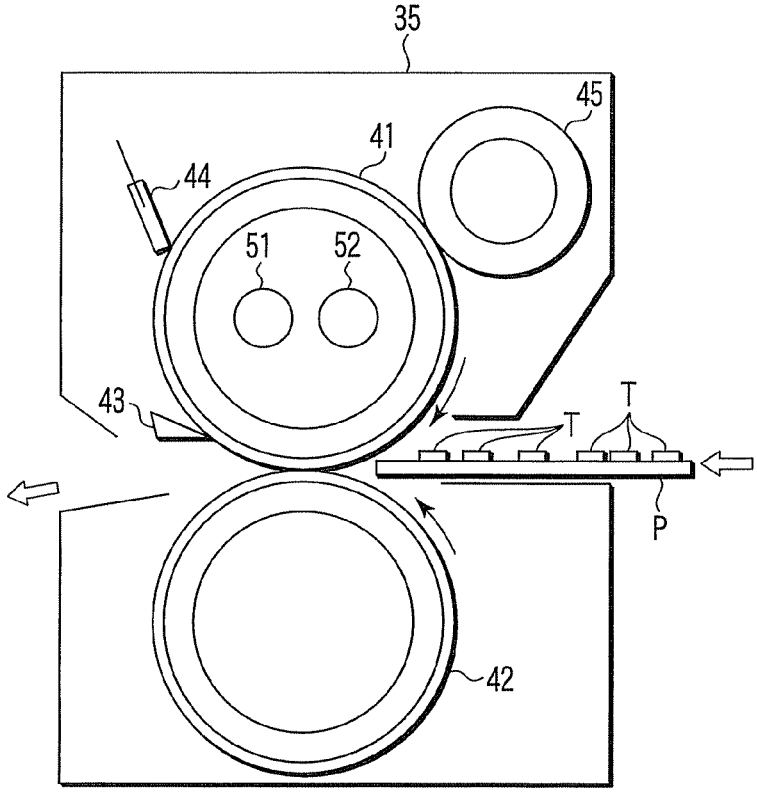
FIG. 2 is a diagram showing a structure of a main part of a fixing unit in a first embodiment.

A specific structure of the fixing unit 35 is shown in FIG. 2.

A heating roller 41 and a pressure roller 42 are provided in positions above and below a conveying path of the paper sheet P. The pressure roller 42 is set in contact with a peripheral surface of the heating roller 41 in a pressing state by a not-shown pressing mechanism. A contact portion of these rollers 41 and 42 has a fixed nip width.

The heating roller 41 is obtained by molding a conductive material, for example, iron in a cylindrical shape and coating an outer peripheral surface of the iron. The heating roller 41 is driven to rotate in a right direction in the figure. The pressure roller 42 receives the rotation of the heating roller 41 and rotates in a left direction in the figure. The paper sheet P passes through the contact section of the heating roller 41 and the pressure roller 42 and receives heat from the heating roller 41, whereby a developing agent image T on the paper sheet P is fixed on the paper sheet P.

Around the heating roller 41, a peeling pawl 43 for peeling the paper sheet P from the heating roller 41, a cleaning member 44 for removing a toner, paper dust, and the like remaining on the heating roller 41, and an applying roller 45 for applying a release agent on the surface of the heating roller 41 are disposed.

A first electric heater, for example, a halogen heater 51 and a second electric heater, for example, a halogen heater 52 are housed in the inside of the heating roller 41. The heating roller 41 is heated by these halogen heaters 51 and 52.

Figure 3:
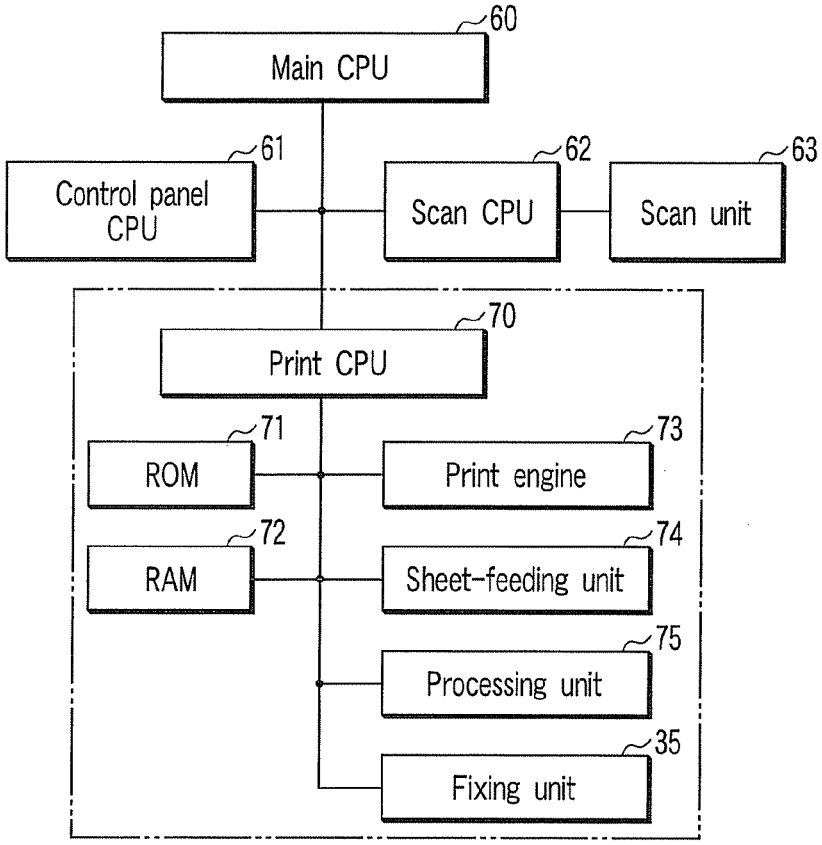
FIG. 3 is a block diagram of a control circuit of each embodiment.

A control circuit of the main body 1 is shown in FIG. 3.

A control panel CPU 61, a scan CPU 62, and a print CPU 70 are connected to a main CPU 60. A scan unit 63 is connected to the scan CPU 62. The main CPU 60 collectively controls the control panel CPU 61, the scan CPU 62, and the print CPU 70.

A ROM 71 for control program storage, a RAM 72 for data storage, a print engine 73, a sheet conveying unit 74, a processing unit 75, and the fixing unit 35 are connected to the print CPU 70.

Figure 4:
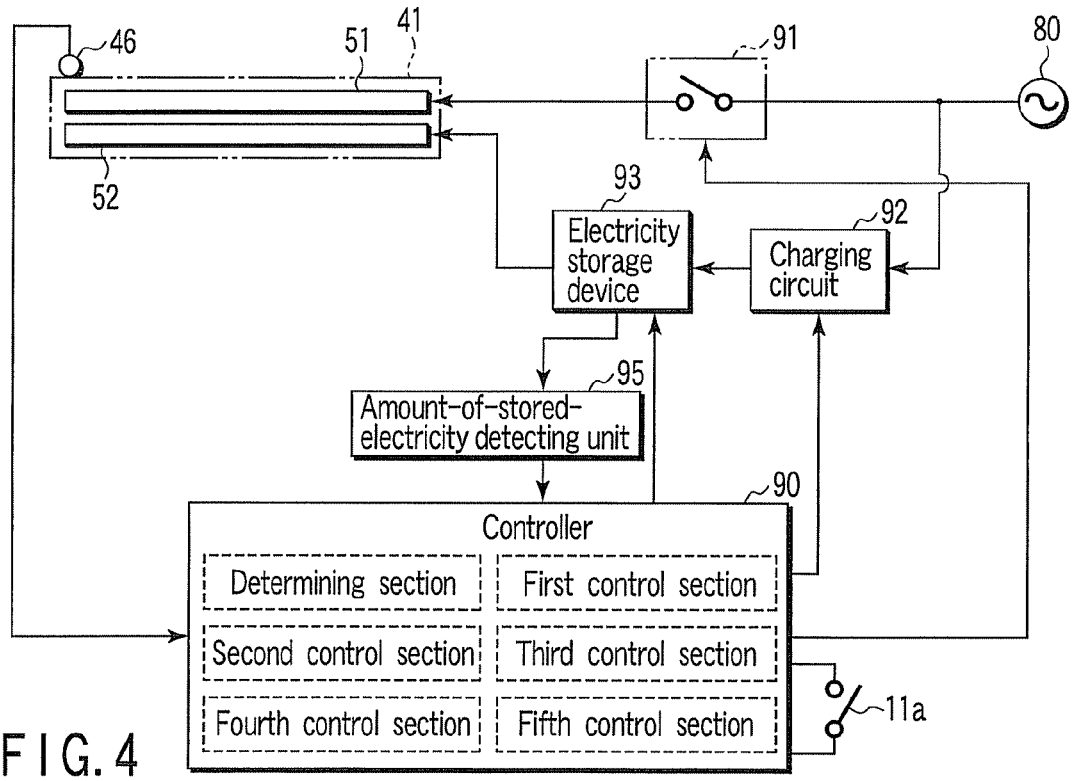
FIG. 4 is a block diagram of an electric circuit of the fixing unit in the first embodiment.

An electric circuit of the fixing unit 35 is shown in FIG. 4.

A voltage of the commercial AC power supply 80 as a main power supply is supplied to the halogen heater 51 in the heating roller 41 via a relay contact 91. The relay contact 91 is turned on and off according to a command of a controller 90. The halogen heater 51 is a heater of an AC type that operates with an AC voltage.

A voltage of the commercial AC power supply 80 is supplied to an electricity storage device 93 via a charging circuit 92. An output voltage (a DC voltage) of the electricity storage device 93 is supplied to the halogen heater 52 in the heating roller 41. The electricity storage device 93 is, for example, a capacitor or a storage battery and can be charged by the charging circuit 92 and discharged according to a command of the controller 90. The charging circuit 92 charges the electricity storage device 93 according to a command of the controller 90. The halogen heater 52 is a heater of a DC type that operates with a DC voltage.

A temperature sensor 46 is attached to the heating roller 41. A detection signal of the temperature sensor 46 is supplied to the controller 90. An amount-of-stored-electricity detecting unit 93 that detects an amount of stored electricity of the electricity storage device 93 is connected to the electricity storage device 95. A detection signal of the amount-of-stored-electricity detecting unit 95 is supplied to the controller 90. A switch 11*a* associated with on and off of the main switch 11 is connected to the controller 90.

The controller 90 has the following means of (1) to (6) as main functions.

(1) A determining section that determines, on the basis of a detection result of the amount-of-stored-electricity detecting unit 95, whether charging of the electricity storage device 93 is necessary. For example, the determining section determines that charging is necessary when an amount of stored electricity decreases to be smaller than 80% and determines that charging is unnecessary when an amount of stored electricity increases to be equal to or larger than 80%.

(2) A first control section that starts, when the switch 11*a* (the main switch 11) is off and it is determined by the determining section that the charging is necessary, an operation of the charging circuit 92 and charges the electricity storage device 93 with electric power of the commercial AC power supply 80.

(3) A second control section that stops, when the switch 11*a* is off and it is determined by the determining section that charging is unnecessary, the operation of the charging circuit 92 and stops the charging of the electricity storage device 93 by the electric power of the commercial AC power supply 80.

(4) A third control section that starts, when the switch 11*a* is turned on, if the electricity storage device 93 has been charged to that point, the operation of the charging circuit 92 and suspends the charging.

(5) A fourth control section that turns on, when the switch 11*a* is on and warming-up of the fixing unit 35 is necessary (when a detected temperature of the temperature sensor 46 has not reached temperature necessary for fixing), the relay contact 91 to actuate the halogen heater 51 with the electric power of the commercial AC power supply 80 and discharges the electricity storage device 93 to actuate the halogen heater 52 with electric power of the discharge.

(6) A fifth control section that resumes, when the switch 11*a* is on and the warming-up of the fixing unit 35 is finished, if the charging of the electricity storage device 93 has been suspended by the third control section, the operation of the charging circuit 92 and resumes the charging of the electricity storage device 93 by the electric power of the commercial AC power supply 80.

Figure 5:
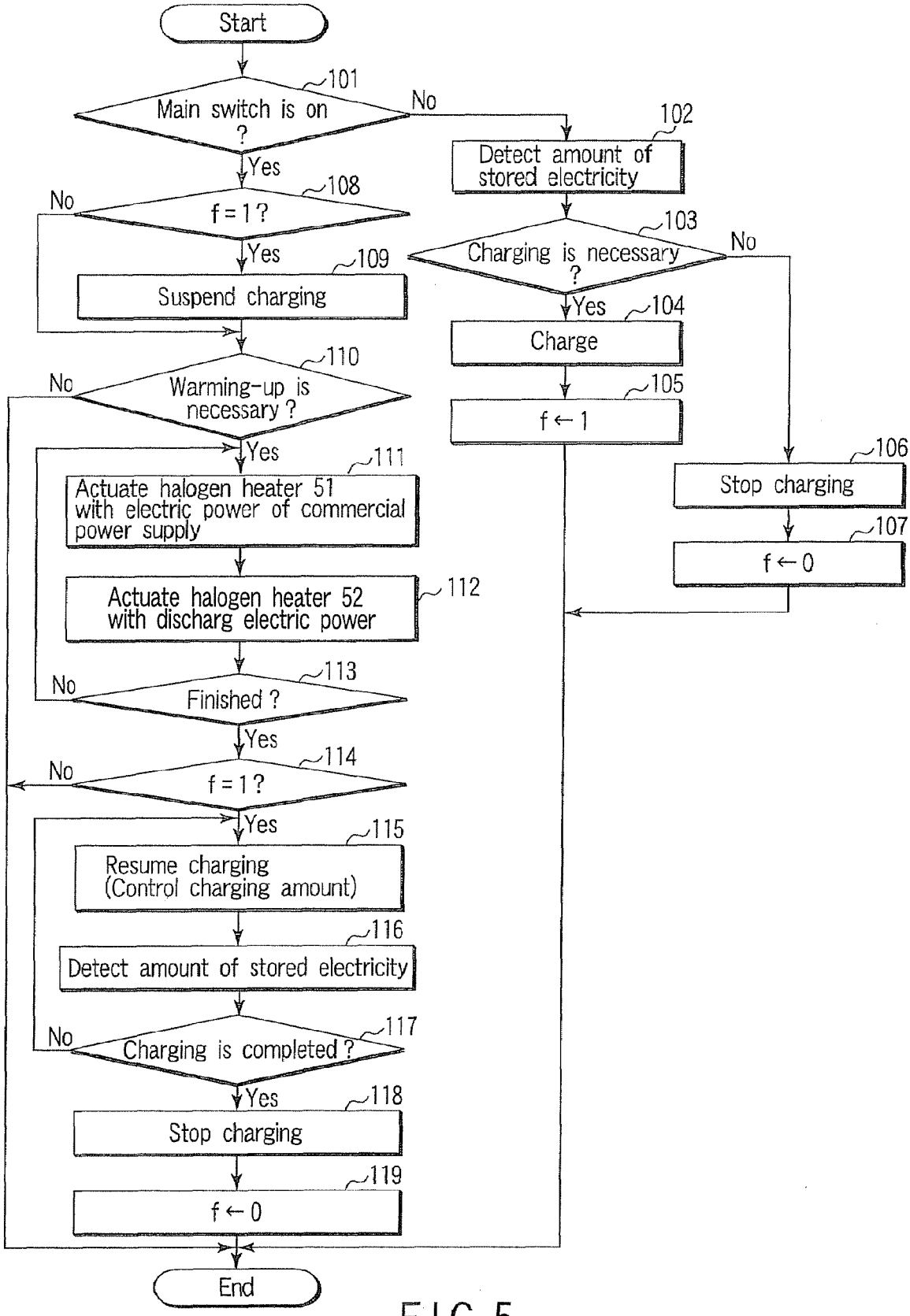
FIG. 5 is a flowchart for explaining actions of the first embodiment.

Actions will be explained with reference to a flowchart in FIG. 5.

When the main switch 11 (the switch 11*a*) is off (NO in step 101), an amount of stored electricity of the electricity storage device 93 is detected (step 102). When the amount of stored electricity detected is smaller than 80%, it is determined that charging is necessary (YES in step 103). In this case, the electricity storage device 93 is charged by the electric power of the commercial AC power supply 80 (step 104). A charging flag f is set to "1" (step 105).

When the charging progresses and the amount of stored electricity of the electricity storage device 93 increases to be equal to or larger than 80%, it is determined that charging is unnecessary (NO in step 103). In this case, the charging of the electricity storage device 93 is stopped (step 106). The charging flag f is set to "0" (step 107).

On the other hand, when the main switch 11 (the switch 11*a*) is turned on (YES in step 101), it is determined whether the charging flag f is "1" (step 108). When the charging flag f is "1" (YES in step 108), under determination that the electricity storage device 93 has been charged to that point, the charging of the electricity storage device 93 is suspended (step 109) and the processing shifts to processing in step 110. When the charging flag f is "0" (NO in step 108), under determination that the electricity storage device 93 has not been charged to that point, the processing directly shifts to processing in step 110.

In step 110, it is determined whether the warming-up of the fixing unit 35 is necessary. When the temperature of the heating roller 41 is detected by the temperature sensor 46 and the detected temperature has not reached temperature necessary for fixing, it is determined that warming-up is necessary (YES in step 110). At this point, the relay contact 91 is turned on and the halogen heater 51 operates with the electric power of the commercial AC power supply 80 (step 111). At the same time, the electricity storage device 93 is discharged and the halogen heater 52 operates with electric power of the discharge (step 112). According to the operations of these halogen heaters 51 and 52, the warming-up of the fixing unit 35 is started.

This warming-up is continued until a detected temperature of the temperature sensor 46 reaches the temperature necessary for fixing. When the warming-up is finished (YES in step 113), it is determined whether the charging flag f is "1" (step 114). When the charging flag f is "1" (YES in step 114), under determination that the charging of the electricity storage device 93 has been suspended, the charging of the electricity storage device 93 is resumed by the electric power of the commercial AC power supply 80 (step 115). In the resumption of the charging, an amount of charging to the electricity storage device 93 is controlled according to power consumption of the entire main body 1 to prevent the charging from hindering other operations of the main body 1. An amount of stored electricity of the electricity storage device 93 is detected (step 116).

When the amount of stored electricity detected increases to be equal to or larger than 80%, it is determined that the charging is completed (YES in step 117). At this point, the charging to the electricity storage device 93 is stopped (step 118) and the charging flag f is set to "0" (step 119).

As explained above, the two halogen heaters 51 and 52 are provided in the heating roller 41 of the fixing unit 35 and the halogen heater 51 is actuated by the electric power of the commercial AC power supply 80. In addition, the halogen heater 52 is actuated by the electricity storage device 93. This makes it possible to substantially reduce time required for the warming-up of the fixing unit.

Since the electricity storage device 93 is charged when the main switch 11 is off, it is possible to apply most of the electric power of the commercial AC power supply 80 to the charging of the electricity storage device 93. Thus, it is possible to reduce time required for the charging of the electricity storage device 93. For example, when a rated current of the commercial AC power supply 80 is 15 A, it is possible to charge the electricity storage device 93 with an electric current equal to or higher than 14 A.

Since, naturally, the charging of the electricity storage device 93 is suspended during the warming-up of the fixing unit 35, it is possible to use the electric power of the commercial AC power supply 80 for the warming-up of the fixing unit 35 as much as possible.

Since the charging of the electricity storage device 93 is resumed after the warming-up of the fixing unit 35 is finished, it is possible to reserve an amount of stored electricity of the electricity storage device 93 in a sufficient state in preparation for the next warming-up.

[2] A second embodiment will be explained.

Figure 6:
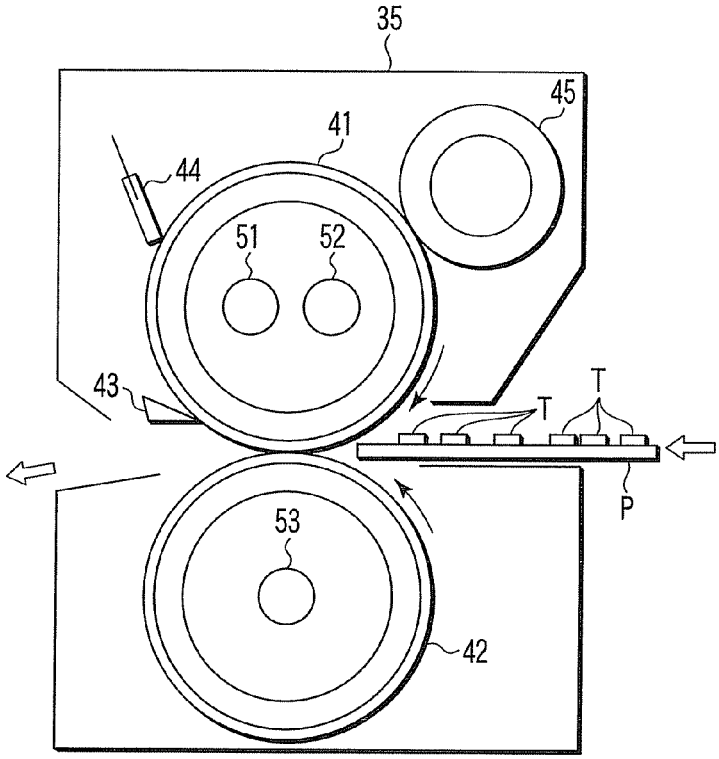
FIG. 6 is a diagram showing a structure of a main part of a fixing unit in a second embodiment.

As shown in FIG. 6, a third electric heater, for example, a halogen heater 53 is housed in the pressure roller 42 of the fixing unit 35. The pressure roller 42 is heated by this halogen heater 53.

Figure 7:
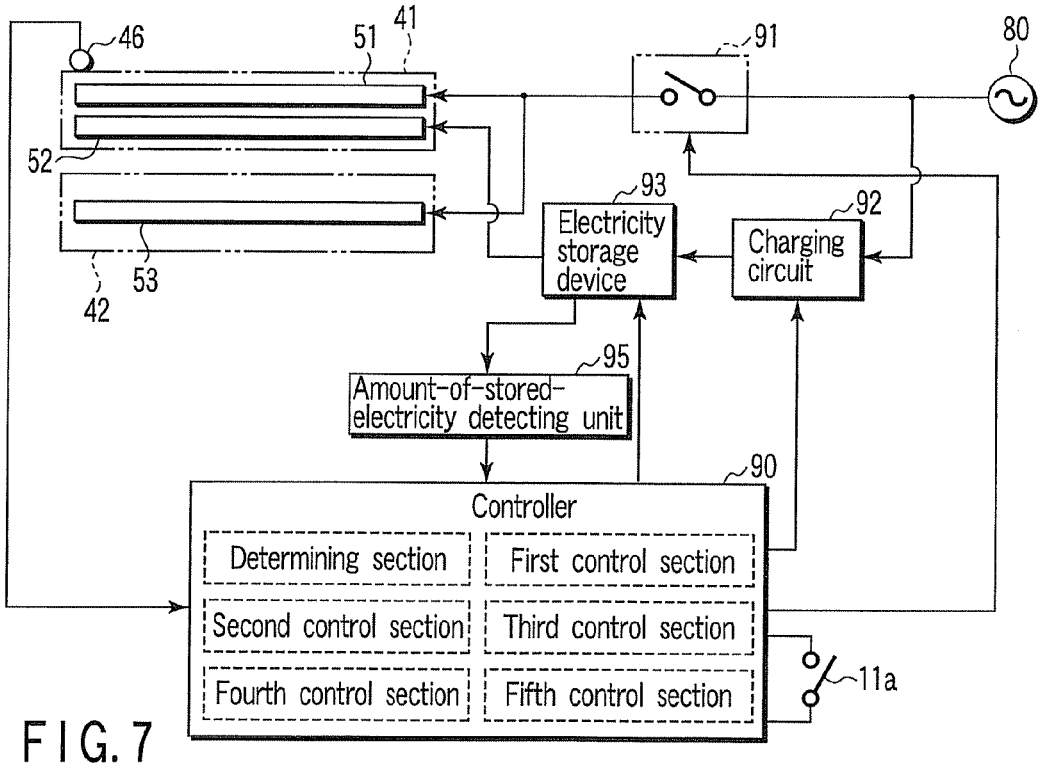
FIG. 7 is a block diagram of an electric circuit of the fixing unit in the second embodiment.

As shown in FIG. 7, a voltage of the commercial AC power supply 80 as the main power supply is supplied to the halogen heaters 51 and 53 via the relay contact 91. The halogen heater 53 is a heater of the AC type that operates with an AC voltage in the same manner as the halogen heater 51.

Figure 8:
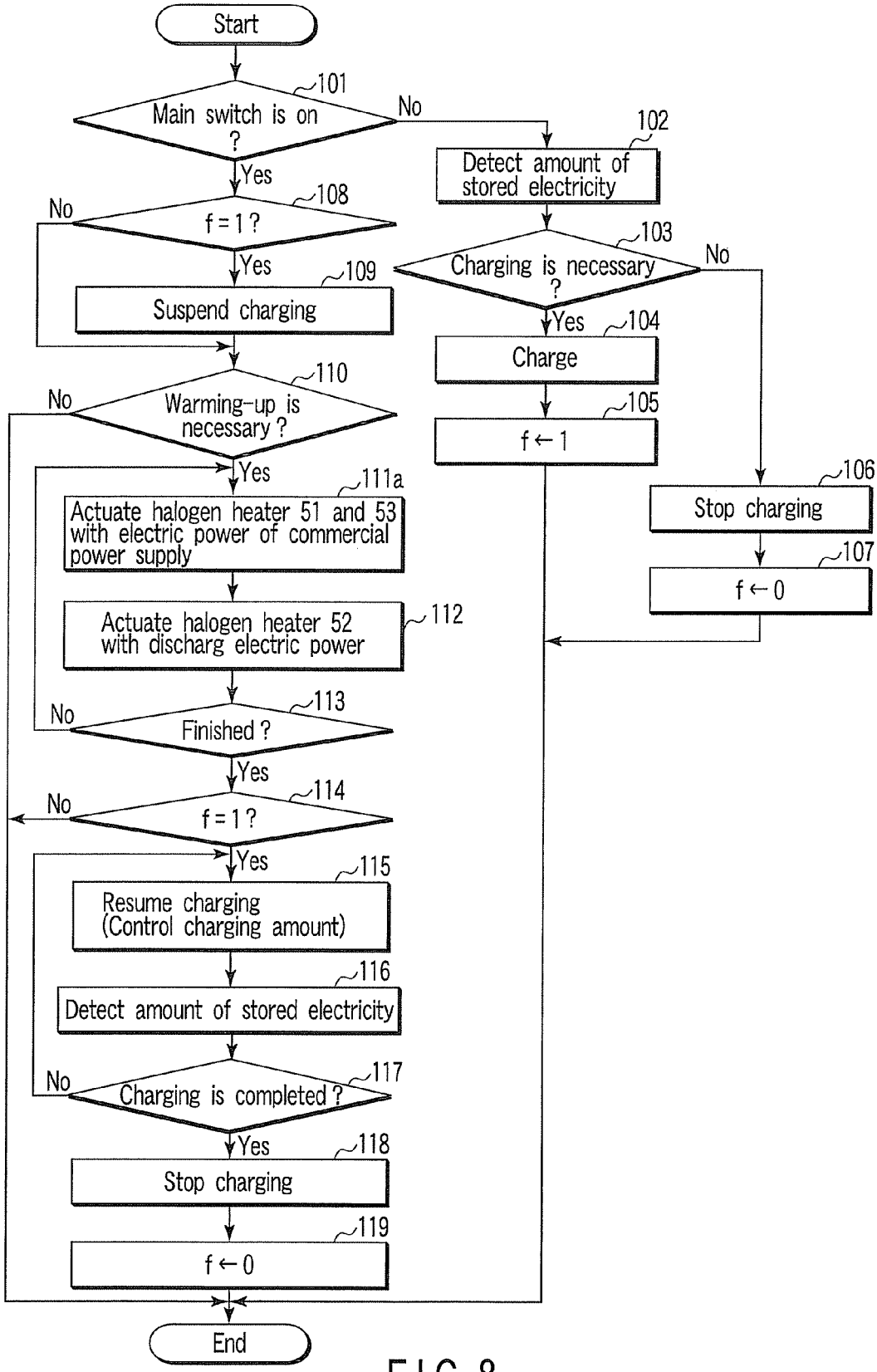
FIG. 8 is a flowchart for explaining actions of the second embodiment.

Actions are shown in a flowchart in FIG. 8. Processing in step 111*a* is executed instead of the processing in step 111 in the first embodiment. When the warming-up is necessary (YES in step 110), the relay contact 91 is turned on and the halogen heaters 51 and 53 operate with the electric power of the commercial AC power supply 80 (step 111*a*).

Other components, actions, and effects are the same as those in the first embodiment.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. An image forming apparatus comprising:

a main switch that permits an operation of the image forming apparatus by electric power of a main power supply according to turn-on of the main switch and prohibits the operation according to turn-off of the main switch;

a fixing unit configured to have a heating roller;

a first electric heater and a second electric heater provided in the heating roller;

an electricity storage device that can be charged and discharged; and a first control section configured to charge the electricity storage device with the electric power of the main power supply when the main switch is off;

a second control section configured to stop the charging of the electricity storage device by the electric power of the main power supply according to a situation when the main switch is off;

a third control section configured to suspend, when the main switch is turned on, if the electricity storage device has been charged to that point, the charging;

a fourth control section configured to actuate the first electric heater with the electric power of the main power supply and actuates the second electric with discharge electric power of the electricity storage device when the main switch is on and the warming-up of the fixing unit is necessary; and a fifth control section configured to resume, when the main switch is on and the warming-up of the fixing unit is finished, if the charging of the electricity storage device has been suspended by the third control section, the charging of the electricity storage device by the electric power of the main power supply.

2. The apparatus according to claim 1, further comprising:

an amount-of-stored-electricity detecting unit configured to detect an amount of stored electricity of the electricity storage device; and a determining section configured to determine, on the basis of a detection result of the amount-of-stored-electricity detecting unit, whether charging of the electricity storage device is necessary.

3. The apparatus according to claim 2, wherein the first control section configured to charge, when the main switch is off and it is determined by the determining section that the charging is necessary, the electricity storage device with the electric power of the main power supply;

the second control section configured to stop, when the main switch is off and it is determined by the determining section that the charging is unnecessary, the charging of the electricity storage device by the electric power of the main power supply;

the fourth control section configured to actuate the first electric heater with the electric power of the main power supply and actuates the second electric heater with discharge electric power of the electricity storage device when the main switch is on and the warming-up of the fixing unit is necessary.

4. The apparatus according to claim 1, wherein the fixing unit has the heating roller and has a pressure roller, and the pressure roller rotates together with the heating roller while being in contact with the heating roller in a pressing state and has a third electric heater in an inside thereof.

5. The apparatus according to claim 4, wherein the fourth control section configured to actuate the first electric heater and the third electric heater with the electric power of the main power supply and actuate the second electric heater with the discharge electric power of the electricity storage device when the main switch is on and the warming-up of the fixing unit is necessary.

6. The apparatus according to claim 4, further comprising:

an amount-of-stored-electricity detecting unit configured to detect an amount of stored electricity of the electricity storage device; and a determining section configured to determine, on the basis of a detection result of the amount-of-stored-electricity detecting unit whether charging of the electricity storage device is necessary.

7. The apparatus according to claim 6, wherein the first control section configured to charge the electricity storage device with the electric power of the main power supply when the main switch is off and it is determined by the determining section that the charging is necessary; and the second control section configured to stop, when the main switch is off and it is determined by the determining section that the charging is unnecessary, the charging of the electricity storage device by the electric power of the main power supply.

8. An image forming apparatus comprising:

a main switch that permits an operation of the image forming apparatus by electric power of a main power supply according to turn-on of the main switch and prohibits the operation according to turn-off of the main switch;

a fixing unit having a heating roller;

a first electric heater and a second electric heater provided in the heating roller;

electricity storing means that can be charged and discharged;

first controlling means for charging the electricity storing means with the electric power of the main power supply when the main switch is off;

second controlling means for stopping the charging of the electricity storing means by the electric power of the main power supply according to a situation when the main switch is off;

third controlling means for suspending, when the main switch is turned on, if the electricity storing means has been charged to that point, the charging;

fourth controlling means for actuating the first electric heater with the electric power of the main power supply and actuating the second electric heater with discharge electric power of the electricity storing means when the main switch is on and the warming-up of the fixing unit if necessary; and fifth controlling means for resuming, when the main switch is turned on and the warming-up of the fixing unit is finished, if the charging of the electricity storing means has been suspended by the third controlling means, the charging of the electricity storing means by the electric power of the main power supply.

9. The apparatus according to claim 8, further comprising:

detecting means for detecting an amount of stored electricity of the electricity storing means; and determining means for determining, on the basis of a detection result of the detecting means, whether charging of the electricity storing means is necessary.

10. The apparatus according to claim 9, wherein first controlling means for charging, when the main switch is off and it is determined by the determining means that the charging is necessary, the electricity storing means with the electric power of the main power supply;

second controlling means for stopping, when the main switch is off and it is determined by the determining means that the charging is unnecessary, the charging of the electricity storing means by the electric power of the main power supply; and fourth controlling means for actuating the first electric heater with the electric power of the main power supply and actuating the second electric heater with discharge electric power of the electricity storing means when the main switch is on and the warming-up of the fixing unit is necessary;

11. The apparatus according to claim 8, wherein the fixing unit has the heating roller and has a pressure roller, and the pressure roller rotates together with the heating roller while being in contact with the heating roller in a pressing state and has a third electric heater in an inside thereof.

12. The apparatus according to claim 11, wherein fourth controlling means for actuating the first electric heater and the third electric heater with the electric power of the main power supply and actuating the second electric heater with the discharge electric power of the electricity storing means when the main switch is on and the warming-up of the fixing unit is necessary.

13. The apparatus according to claim 11, further comprising detecting means for detecting an amount of stored electricity of the electricity storing means; and determining means for determining, on the basis of a detection result of the detecting means, whether charging of the electricity storing means is necessary.

14. The apparatus according to claim 13, wherein first controlling means for charging the electricity storing means with the electric power of the main power supply when the main switch is off and it is determined by the determining means that the charging is necessary; and second controlling means for stopping, when the main switch is off and it is determined by the determining means that the charging is unnecessary, the charging of the electricity storing means by the electric power of the main power supply.

15. A method of controlling an image forming apparatus including a main switch that permits an operation of the image forming apparatus by electric power of a main power supply according to turn-on of the main switch and prohibits the operation according to turn-off of the main switch, a fixing unit having a heating roller, a first electric heater and a second electric heater provided in the heating roller, and an electricity storage device that can be charged and discharged, the method comprising:

charging the electricity storage device with the electric power of the main power supply when the main switch is off;

stopping the charging of the electricity storage device by the electric power of the main power supply according to a situation when the main switch is off;

suspending when the main switch is turned on, if the electricity storage device has been charged to that point, the charging;

actuating the first electric heater with the electric power of the main power supply and actuating the second electric heater with discharge electric power of the electricity storage device when the main switch is on and the warming-up of the fixing unit is necessary; and resuming, when the main switch on and the warning-up of the fixing unit is finished, if the charging of the electricity storage device has been suspended by the suspending, the charging of the electricity storage device by the electric power of the main power supply.

* * * * *